United States Patent [19]

Jacrot

[11] Patent Number: 4,843,276

[45] Date of Patent: Jun. 27, 1989

[54] ELECTRIC INCANDESCENT LAMP ASSEMBLY HAVING SIMPLIFIED CONSTRUCTION

[75] Inventor: Michel Jacrot, Barjouville, France

[73] Assignee: U.S. Philips Corporation, New York, N.Y.

[21] Appl. No.: 283,049

[22] Filed: Dec. 6, 1988

Related U.S. Application Data

[63] Continuation of Ser. No. 18,108, Feb. 20, 1987, abandoned.

[30] Foreign Application Priority Data

Feb. 25, 1986 [FR] France ..... 86 02569

[51] Int. Cl.[4] ..... H01J 5/48; H01J 5/50

[52] U.S. Cl. ..... 313/318; 313/315

[58] Field of Search ..... 313/315, 318, 579

[56] References Cited

U.S. PATENT DOCUMENTS

| | | | |
|---|---|---|---|
| 4,122,367 | 10/1978 | Esklavon et al. | 313/318 |
| 4,492,893 | 1/1985 | Steiner et al. | 313/318 |
| 4,567,397 | 1/1986 | Wilhelm et al. | 313/318 |
| 4,622,486 | 11/1986 | Endo | 313/579 |

*Primary Examiner*—Benedict V. Safourek
*Assistant Examiner*—T. Salindang
*Attorney, Agent, or Firm*—Brian J. Wieghaus

[57] ABSTRACT

The electric incandescent lamp of the H1 type according to the invention is provided with a bulb having a seal which is inserted into a metallic lamp holder. Welding tongues on the holder at the ends remote from the bulb extend away from the bulb in line with a respective holder side. The lamp comprises a metallic base plate provided with a muff or tubular portion, into which a conducting contact is inserted, which is coated with an insulating material. The tongues are welded to the muff. The base tubular portion permits sintering of a ceramic powder around the conducting contact to form a rigid insulating body.

18 Claims, 1 Drawing Sheet

ELECTRIC INCANDESCENT LAMP ASSEMBLY HAVING SIMPLIFIED CONSTRUCTION

This is a continuation of application Ser. No. 018,108, filed Feb. 20, 1987, now abandoned.

BACKGROUND OF THE INVENTION

This invention relates to an electric incandescant lamp provided with a tubular gas-tight glass bulb, of which at least one end has a seal. Current supply conductors extend through the wall of the bulb and carry a helical filament. A metallic envelope having a substantially rectangular cross-section and welding tongues accommodates a seal of the bulb. The envelope tongues are welded to a metallic centering base plate which is provided with a central hole and two contiguous parallel gaps, in which a respective welding tongue extends.

Such a lamp of the H3 type is known from French Patent No. 2,341,197 to which U.S. Pat. No. 4,122,367 corresponds. The lamp comprises a metallic envelope in which welding tongues are cut out taking the form of hooks and bent so as to project from walls of the envelope, these tongues being arranged in the gaps of the centering base plate and being fixed to lugs cut and folded from the base plate. Thus, the tongues of the envelope having a comparatively small thickness cover the comparatively thick lugs of the centering base plate to which the said tongues are welded.

In the case of lamps of the H3 type, one of the current supply conductors is connected to an insulated cable, the other one being connected to the metallic envelope.

Such a structure can be used only for a lamp of the H3 type. In fact, the standardization of the lamps of the H3 type does not impose maximum limit values on the distance between the welding tongues of the metallic envelope after the latter have been welded to the base plate. This permits of forming the lugs of the centering base plate in a sufficient thickness to withstand mechanical pressure during the spot welding of the tongues of the envelope.

For given lamp types, such as, for example, a lamp of the H1 type, a maximum limit value is imposed on the thickness of the metallic envelope of the lamp in a zone lying between the metallic centering base plate and the bulb, the said zone being adjacent to the base plate. Consequently, it is not possible to use the structure described in the aforementioned French Patent, which structure is only suitable in standardized lamps of the H3 type.

In order to satisfy the standardization requirements, the lamps of the H1 type which are commercially available have a metallic envelope traversing a base plate, of which four rectangularly bent cutout parts are spotwelded to the walls of the metallic envelope, the part of the envelope adjacent to the base plate and situated opposite to the part carrying the bulb having a conducting contact coated with an insulating resin and secured by means of a stamping tool. One of the current supply conductors is connected to this conducting contact, while the other one is connected to the metallic envelope.

However, these lamps have a disadvantage. In the electric incandescent lamps used in optical systems, the position of the filament with respect to the optical system is subjected to narrow tolerances. With the known H1 lamps, it is difficult to observe these tolerances due to the fact that the metallic base plate is held in place without a support with respect to the metallic envelope at the moment of spotwelding of the four cut out parts which are fairly thick and rigid.

Moreover, the insulating material coating the central contact is often a ceramic material, which insulates better, but is more liable to break. This material cannot be used in a known design of H1 type lamps because, if ceramic material is secured in the lower part of the envelope by means of a stamping tool, this leads to the destruction of this material.

SUMMARY OF THE INVENTION

The invention has for its object to provide a lamp of the kind described in the opening paragraph, whose structure enables, while observing the standards, to improve the operation of assembling the lamp.

Moreover, the invention has for its object to provide for a lamp having a structure which permits an improved insulation of the conducting contact with respect to the base plate.

According to the invention, this object is achieved in that the metallic base plate is provided with a muff or tubular portion in which a conducting contact is fixed and envelope by an insulating material, while the welding tongues extend substantially in line with the metallic envelope and are welded to respective walls of said muff.

During the operation of assembling the lamp, the metallic base plate, the conducting contact and its insulating envelope constitute a unit, which facilitates the manufacturing of the lamp. Moreover, the structure of the lamp facilitates the use of a ceramic material as insulating material. In fact, the muff or tubular portion of the metallic base plate can serve as a mold in order to introduce therein after the positioning of the central contact, a pulverulent material and, as the case may be, a binder, from which a ceramic insulating body is formed by heating. The insulating body, as a consequence, is formed in situ.

During the operation of assembling the envelope or holder provided with its bulb and with the base plate before the welding operation, for example, the spotwelding operation, the distance between the filament and the base plate is fixed upon optical control. The welding tongues of the metallic envelope readily adapt to the muff of the metallic base plate to that they can be readily fixed. The narrow contact between the base plate and the tongues permits a better diffusion of heat by the seal of the bulb and causes a decrease of the temperature of the said seal.

BRIEF DESCRIPTION OF THE DRAWINGS

In order that the invention may be readily carried out, it will now be described more fully, by way of example, with reference to the accompanying drawing, in which.

DESCRIPTION OF THE PREFERRED EMBODIMENT

Figure 1:
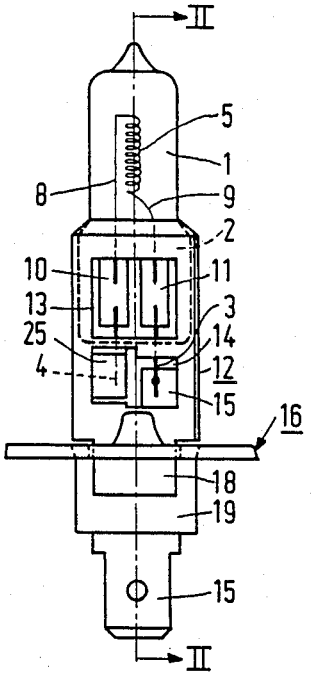
FIG. 1 is a side elevation of a lamp according to the invention.
Figure 2:
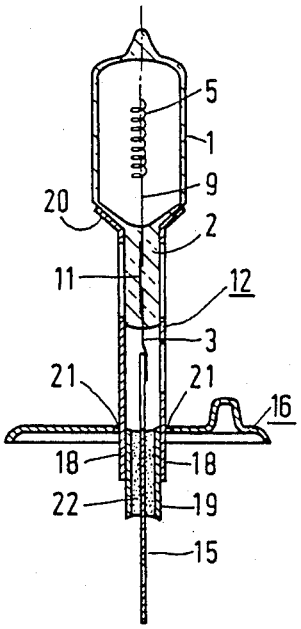
FIG. 2 is a sectional view taken on the line II—II of the lamp shown in FIG. 1.

The lamp shown in FIGS. 1 and 2 has a tubular gas-tight bulb 1 of glass, for example quartz glass, one end of which has a seal 2. Current supply conductors 3,11,9 and 4,10,8 traverse the wall of the bulb 1. A helical filament 5 is longitudinally arranged in the bulb 1 and each of its ends is connected to a current supply conductor 4,10,8 and 3,11,9, respectively. The seal 2 of the bulb 1 is inserted into a tubular metallic holder or envelope 12 having a substantially rectangular crosssection section and provided with windows 13 and 14 which are cut by stamping. The window 13 allows the seal 2 to appear and the window 14 enables welding of part 3 of the current supply conductor 3,11,9 to a conducting contact 15. The stamping of window 14 provides a tongue 25, which, when being welded to a part 4 of the current supply conductor 4,10,8, permits of obtaining an electrical mass contact for the lamp and a rigid connection between the bulb 1 and the metallic envelope 12; the bulb and the metallic envelope then constitute an assembly. This assembly 1,12 is mounted on a metallic centering base plate 16 provided with a muff or tubular portion 19, in which a conducting contact 15 is arranged, which is coated with an insulating material 22. The tubular portion has two opposing major surfaces extending parallel to the lamp axis. The two tongues 18 formed at the end of the part of the envelope 12 opposite to the bulb 1 traverse the base plate 16 and are welded to a respective major surface of muff 19.

FIG. 2 is a sectional view II—II of the lamp shown in FIG. 1. It shows the bulb 1 with its seal 2 depressed in the envelope 12. The bulb bears on a collar 20 which positions it with respect to the lamp holder 12. The conducting contact 15 traverses the base plate 16. The muff 19 has a substantially rectangular cross-section and is formed by stamping during the shaping of the base plate. The welding tongues 18 of the metallic envelope 12 traverse the base plate 16 through two parallel slots 21 and are in contact with and welded to the muff 19. The conducting contact 15 is rigidly connected to the muff 19 through a ceramic body 22, which is obtained by pressing and subsequently sintering ceramic powder around the conducting contact. The metallic base plate 16 with its muff 19, the conducting contact 15 and the insulating ceramic body 22 thus constitute a unit 20.

Figure 3:
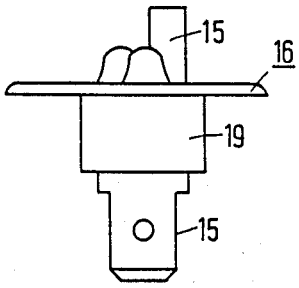
FIG. 3 shows the metallic base plate and the central contact, in side elevation.
Figure 5:
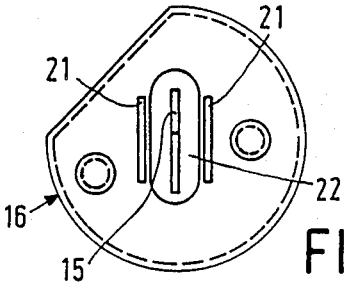
FIG. 5 is a plan view of the base plate and of the coated contact.

FIGS. 3 and 5 show the part composed of the base plate 16 with the muff 19 and the contact 15 as well as the insulating ceramic body 22.

Figure 4:
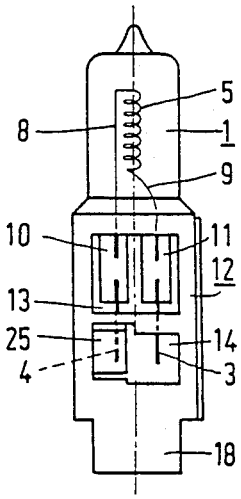
FIG. 4 shows the envelope provided with the bulb.

FIG. 4 shows a detail of the part composed of the bulb 1 mounted in the metallic envelope 12. The envelope 12 is cut in such a manner that the straight tongues 18 extend opposite to the bulb in the prolonged part of the envelope.

What is claimed is:

1. An incandescent lamp assembly, comprising:

a lamp comprising a gas-tight bulb defining a lamp axis, a filament within said bulb, said bulb having a planar press seal with two major opposing surfaces defining a width dimension of said press seal, and a pair of current-supply conductors connected to said filament, passing through said press seal, and extending out of said lamp away from said press seal;

a metallic lamp holder for holding said lamp, said holder comprising two opposing parallel flat walls with said press seal disposed therebetween, each said well having a portion bounding a respective major side of said planar press seal for securing said lamp within said holder, said walls extending away from said press seal parallel to said lamp axis and having a width dimension transverse to the lamp axis, and each wall having an end remote from said bulb terminating in an integral tongue extending away from said bulb in the plane of said wall, and said tongues having a width which is a major part of the width of said holder walls, one of said current-supply conductors of said lamp being connected to said metallic holder; and a metallic base on which said lamp holder is mounted, said base comprising a planar portion transverse to said lamp holder and having two slots aligned with said tongues, a tubular portion between said slots extending from the side of said base facing away from said bulb and in the direction away from said bulb, said tubular portion having two major opposing surfaces parallel with said holder walls spaced so that said lamp holder tongues extend through a respective slot and securely contact a major surface of said tubular portion for aligning said filament and said lamp holder with respect to said base, means for fixing each tongue to a respective major surface of said tubular portion, a conductive contact extending through said tubular portion connected to the other of said current-supply conductors, and an insulative material within the space between said tubular portion and said contact for electrically insulating said contacting from said lamp base.

2. A lamp as claimed in claim 1, wherein said insulative material is a ceramic.

3. A lamp as claimed in claim 2, wherein said metallic holder is tubular and has a rectangular cross-section.

4. A lamp as claimed in claim 2, wherein said metallic holder comprises a collar against which said bulb bears for supporting said bulb and positioning said filament with respect to said holder.

5. A lamp as claimed in claim 4, wherein said metallic holder comprises a tab integral with said metallic holder extending transverse to the lamp axis within said tubular portion, and said one current-supply conductor is connected to said transverse tab for establishing a conductive contact between said one current-supply conductor and said metallic holder.

6. A lamp as claimed in claim 1, wherein said metallic holder is tubular and has a rectangular cross-section.

7. A lamp as claimed in claim 1, wherein said metallic holder comprises a collar against which said bulb bears for supporting said bulb and positioning said filament with respect to said holder.

8. A lamp as claimed in claim 1, wherein said metallic holder comprises a tab integral with said metallic holder extending transverse to the lamp axis within said tubular portion, and said one current-supply conductor is connected to said transverse tab for establishing a conductive contact between said one current-supply conductor and said metallic holder.

9. A lamp assembly, comprising:

an incandescent lamp comprising a bulb having a planar press seal with two major opposing surfaces defining a width dimension, a coiled filament arranged in said bulb transverse to said width dimension, the axis of said filament defining a lamp axis, and a pair of current-supply conductors connected to said filament extending through said pinch seal spaced from said lamp axis along said width dimension in a side-by-side arrangement, each current-supply conductor protruding from said press seal and terminating at adjacent free ends;

a tubular metallic lamp holder aligned with said lamp axis having a substantially rectangular cross-section, said lamp holder comprising two major sides spaced for engaging said two major press seal surfaces to fixedly secure said bulb in said holder, a pair of tongues located at the end of said lamp holder remote from said bulb each extending from a respective major side away from said bulb, each tongue being in the plane of its respective major side and having a width which is a major part of width of said major sides, said holder having a window opposite said adjacent ends of said current-supply conductors and a tab projecting from an edge of said window into the interior of said lamp holder having a portion extending parallel to said major sides and transverse to said lamp axis, one of said current-supply conductors being welded to said transverse tab portion for establishing a conductive contact between said one current-supply conductor and said metallic lamp holder; and a metallic base on which said lamp holder is mounted, said base comprising a plate transverse to said lamp axis having a pair of spaced slots, a tubular portion between said slots aligned with said lamp axis extending away from said bulb, a blade-shaped contact extending through said tubular portion having one end protruding from said tubular portion away from said bulb and a portion extending into the interior of said lamp holder offset from the lamp axis along the width dimension of the lamp holder and terminating adjacent said tab of said lamp holder, and tab and said terminal end of said contact being in side-by-side arrangement, the other of said current-supply conductors being welded to said terminal end of said blade-shaped contact, and a ceramic body insulating said blade shaped contact from said tubular portion along the entire length of said tubular portion and rigidly connecting said blade-shaped contact to said tubular portion, said tubular portion having a rectangular cross-sectional with two opposing major walls, said slots and said major walls being spaced so that said lamp holder tongues extend through a respective slot and securely contact a respective major wall for aligning said lamp holder and said filament with said base, each tongue being welded to its respective major wall.

10. A lamp assembly as claimed in claim 8, wherein said ceramic body comprises a powdered ceramic material sintered around said blade-shaped contact.

11. A lamp assembly as claimed in claim 8, wherein said lamp holder comprises a collar extending along the periphery of said bulb in the region of said bulb adjacent said press seal for supporting said bulb and positioning said filament with respect to said lamp holder.

12. A lamp assembly as claimed in claim 8, wherein said window opposite said adjacent ends of said current-supply conductors is sized for facilitating the welding of said current supply conductors to said tab and said terminal end of said contact by a welding tool inserted through said window.

13. A lamp assembly as claimed in claim 8, wherein said base tubular portion is formed from stamping and metal forming said transverse base plate.

14. A lamp assembly as claimed in claim 13, wherein said ceramic body comprises a powdered ceramic material sintered around said blade-shaped contact.

15. A lamp assembly as claimed in claim 8, wherein each of said current-supply conductors comprises a first conductor extending from a respective end of said filament into said press seal, a second conductor extending out of said press seal aligned with said first conductor, and a flat metallic foil extending through a major part of said press seal welded to each conductor for establishing a conductive path through said press seal.

16. A lamp assembly as claimed in claim 15, wherein one of said major sides of said lamp holder in the region of said press seal has a window which extends outwardly along the width dimension of said press seal past each flat metallic foil and extends in the axial direction over the major part of said flat metallic foils.

17. A lamp assembly as claimed in claim 16, wherein said window opposite said adjacent ends of said current-supply conductors is sized for facilitating the welding of said current supply conductors to said tab and said terminal end of said contact by a welding tool inserted through said window.

18. A lamp assembly as claimed in claim 17, wherein said base plate is circular over a major part of its circumference and has a straight edge skewed with respect to said blade-shaped contact for defining the orientation of said lamp assembly.

* * * * *